United States Patent [19]

Moran

[11] Patent Number: 4,913,224

[45] Date of Patent: Apr. 3, 1990

[54] CHILL ROLL

[75] Inventor: Kenneth J. Moran, Appleton, Wis.

[73] Assignee: W. R. Grace & Co.-Conn., Lexington, Mass.

[21] Appl. No.: 335,842

[22] Filed: Apr. 10, 1989

Related U.S. Application Data

[63] Continuation of Ser. No. 203,075, Jun. 7, 1988, abandoned.

[51] Int. Cl.[4] ..... F28F 5/02

[52] U.S. Cl. ..... 165/89; 165/90

[58] Field of Search ..... 165/89, 90

[56] References Cited

U.S. PATENT DOCUMENTS

| | | | |
|---|---|---|---|
| 2,300,528 | 11/1942 | Sherts | 165/89 |
| 2,365,678 | 12/1944 | Butler | 165/89 |
| 2,915,293 | 12/1959 | Justus . | |
| 3,006,610 | 10/1961 | Siegel | 165/89 |
| 3,208,513 | 9/1965 | Pendleton | 165/90 |
| 3,291,264 | 12/1966 | Norton . | |
| 4,230,928 | 10/1980 | Janssen | 165/89 |
| 4,351,386 | 9/1982 | Kobler | 165/89 |
| 4,440,214 | 4/1984 | Wedel | 165/90 |
| 4,506,727 | 3/1985 | Swasey | 165/90 |
| 4,582,128 | 4/1986 | Jarreby | 165/90 |
| 4,796,525 | 1/1989 | Schiel et al. | 165/89 |

FOREIGN PATENT DOCUMENTS

WO84/02573 7/1984 PCT Int'l Appl. .

*Primary Examiner*—Albert W. Davis, Jr.
*Attorney, Agent, or Firm*—Hugh D. Jeager

[57] ABSTRACT

A chill roll for cooling a web, such as in the printing industry, where a uniform temperature across the chill roll is maintained. Journals support an outer roll assembly and an inner roll assembly. The inner roll assembly is bearing mounted on the inner ends of opposing journals and the outer roll is rotated about the inner roll, which is weighted to free-wheel about the bearings to minimize rotary motion. Coolant is introduced through the journal on one end and into a center tube, where the coolant uniformly flows in an annular space between the rolls and along the length of the inner and outer roll assemblies to circumferentially traverse between the rotating and stationary outer and inner rolls. This coolant flow provides enhanced heat transfer from the outer rotating chill roll to the circulating coolant. Heated coolant collects and returns through a center tube, and exhausts through the center tube and out through the journal. Turbulence inducer bars between the inner and outer roll assemblies creates a turbulence in the coolant flow between the outer and inner rolls to further enhance heat transfer.

11 Claims, 8 Drawing Sheets

CHILL ROLL

CROSS REFERENCE TO CO-PENDING APPLICATIONS

This is a continuation of Ser. No. 203,075, filed 6/7/88, now abandoned.

BACKGROUND OF THE INVENTION

1. Field of the Invention

The present invention relates to a chill roll for cooling of printing webs, and more particularly, pertains to a chill roll with an outer roll rotating about an inner roll. Coolant is distributed evenly along the interior space between the inner and outer roll, and circulates circumferentially between the rolls to effect a uniform heat transfer across the roasting roll.

2. Description of the Prior Art

Conventional chill rolls used in the printing industry have provided for cooling of a web by passing the web over a chill roll in an effort to reduce the temperature of the web, such as a printed web, to retard ink smearing, and to reduce web temperature before it is wound on a roll.

Coolant was traditionally introduced into one side of the roll whereupon that end of the roll provided for cooling of the web adjacent to the coolant introduction area. As the coolant proceeded to the opposite end of the chill roll, the coolant temperature, as well as the web temperature across the web, increased so that the exhaust end of the roller was warmer than the introduction end of the roller. The net effect was that one edge portion of the web was cooled quite well, but the opposing edge portion was cooled substantially less due to the temperature gradient differential across the chill roll. Other existing chill roll designs featured coolant passages which were located between the outer roll shell and an inner drum, and spiraled from one side of the roll to the other side. Still other existing chill roll structures had outer and inner drums which were rotated together, and as the B coolant traveled across the roll, the coolant was heated by the web so that a temperature differential still existed between the roll surface on leaving and entering the ends.

Prior art chill rolls merely pumped coolant into one end of the roll and simply forced it from the opposing end, which caused the area of the roll adjacent to the inlet to cool effectively. When the coolant picked up heat from the roll, the temperature of the area of the roll adjacent to the outlet end was much warmer than the area adjacent to the inlet. This temperature gradient across the roll would cause the web temperature to be variable in an increasing temperature differential, as well as across the roll and across the web.

Other chill roll designs depended upon an excessive coolant flow to maintain an improved and more constant temperature differential across the chill roll. The greater the flow, the smaller the temperature differential across the roll. The present invention does not require increased coolant flow to maintain a low temperature differential because there is no differential. The same temperature exists across the roll at any given roll tangent.

The present invention overcomes the disadvantages of the prior art devices by providing a chill roll which distributes coolant in an even and uniform fashion along and across the entire length of the chill roll interior so that heat transfer is accomplished circumferentially around and about an annular space and passage between an outer rotating chill roll and a stationary roll assembly Heat transfer is further enhanced by turbulence inducer bars causing turbulence in the coolant flow between the stationary roll and the rotary roll.

SUMMARY OF THE INVENTION

The general purpose of the present invention is to provide a chill roll for uniform cooling across the width of an offset web. The chill roll includes a fluid flow system for delivery of coolant to an integral distribution fluid flow system contained in an inner stationary roll assembly which channels coolant from a coolant supply header, and across the longitudinal length of a chill roll. The coolant flows circumferentially in an annular space between a fixed and a rotary chill roll, and then returns through a coolant return header and return coolant exhaust.

According to one embodiment of the present invention, there is provided a chill roll for reducing the temperature of a web traveling across the chill roll. A pin operator end journal and a drive end journal, each with internal passages, extend through end plates at opposing ends of an outer rotary roll to support a bearing center tube and stationary inner roll assembly, which encompasses the bearing center tube. Supply coolant is introduced into the interior of the stationary inner roll through the drive end journal. The center tube is plugged at a mid-portion so as to divide the center tube into a coolant supply chamber and a coolant return chamber. Holes in these coolant chambers connect to a coolant supply header or a coolant return header adjacent to the coolant supply and return chambers. Thrust washers and coolant cooled carbon bearings position over and about the ends of the journals which extend through the rotary outer roll end plates. The center tube, including the weighted inner roll assembly components, remains stationary and freewheels within the outer rotating roll about the carbon bearings. The stationary chill roll assembly includes circular end discs at each end of the roll which secure to opposite ends of segmented cylndrical segments. The cylindrical segments also intersect the supply and return headers.

Fluid flow is between an annular space of the inner stationary roll and the outer rotating roll. Fluid passes through the end journal, the center tube, the coolant supply chamber, the coolant supply header, the annular space of the rolls, the coolant return header, the coolant return chamber, and an opposing end journal. Turbulence inducer bars about the cylindrical segments enhance heat transfer.

One significant aspect and feature of the present invention is a chill roll with an outer roll rotating about a fixed stationary inner roll. The fixed inner roll is weighted.

Another significant aspect and feature of the present invention is a chill roll where coolant flow is distributed in a substantially equal flow along the length of the chill roll. A substantially constant temperature differential is maintained between the ends of the chill roll and along the length of the chill roll. Heat transfer is further enhanced by turbulence caused by an outer roll rotating about a fixed inner roll. Heat transfer is further enhanced by turbulence caused by turbulence inducer bars in the coolant flow on the outer surface of an inner roll, on the inner surface of an outer roll, or likewise positioned in the coolant flow.

A further significant aspect and feature of the present invention is a chill roll where surface tension between a rotating roll, a fixed roll and the interposed coolant moves coolant by inertial feed between the rolls in the direction of rotation.

Having thus described the embodiments of the present invention, it is a principal object hereof to provide a chill roll for the cooling of an offset web or a like web member.

One object of the present invention is a chill roll which provides for even temperature cooling across the chill roll. The temperature is transferred to the passing web.

Another object of the present invention is a chill roll whose temperature differential is equal across the roll independent of the amount of coolant flow. This provides uniform cooling.

A further object of the present invention is utilizing turbulence flow of the fluid between the outer chill roll and the inner roll to further enhance heat transfer.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
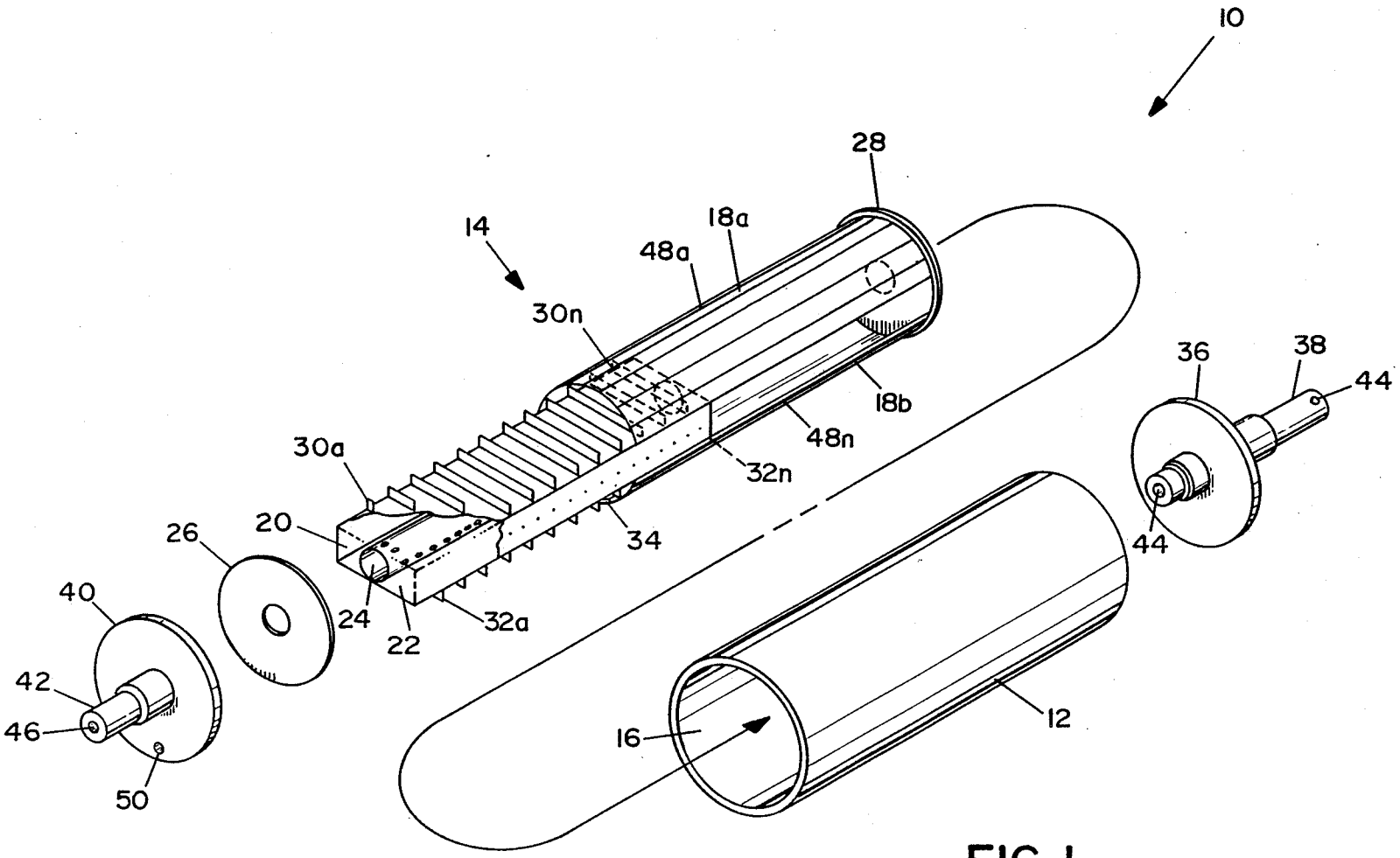
FIG. 1 illustrates an exploded perspective view of the major components of a chill roll.

FIG. 1 illustrates an exploded perspective view of the illustrated major components of a chill roll 10 for use in cooling a web, such as used in printing or other related fields. The chill roll 10 includes a cylindrical outer roll 12 which rotates coaxially about a cylindrical like inner roll assembly 14. The inner roll assembly 14 positions within the interior 16 of the cylindrical outer roll 12, and includes cylindrical segments 18*a* and 18*b*, each secured to the periphery of a channel like coolant supply header 20 and a channel like coolant return header 22. The coolant supply header 20 and the coolant return header 22 secure about a center tube 24. The center tube 24, the coolant supply header 20 and the coolant return header 22 include a plurality of orifices for the channeling or directing of coolant flows about the interior and exteriors of the center tube 24, the coolant supply header 20, and the coolant return header 22. A plurality of upper strengthening gussets 30*a*–30*n* and a plurality of lower strengthening gussets 32*a*–32*n* position across the coolant supply header 20 and the coolant return header 22 in the inner roll assembly 14. End discs 26 and 28 secure in a water tight manner over opposing ends of cylindrical segments 18*a* –18*b*, coolant supply header 20, coolant return header 22 and the center tube 24, each of the preceding elements being a member of the inner roll assembly 14. As described later in detail, a weight 34, resembling a cylinder segment, positions in the bottom of the inner roll assembly 14 along the length of the cylindrical segment 18*b* to counter any rotational tendencies of the inner roll assembly 14. A circular end cap 36, including a drive end journal 38, affixes in one end of the cylindrical outer roll 12. A removable end cap 40, which includes an operator end journal 42, secures in the opposing end of the cylindrical outer roll 12. The drive end journal 38 and the operator end journal 42 extend through end caps 36 and 40, respectively, and into opposing ends of centrally aligned center tube 24 with water cooled carbon bearings 54 and 80 interposed to support the inner roll assembly 14. A cylindrical coolant supply orifice 44, concentric within the drive end journal 38, provides a path for supply coolant to enter the inner roll assembly 14 through the center tube 24. Turbulence inducer bars 48*a*–48*n*, each being a part of the inner roll assembly 14, position longitudinally along the outer surfaces of the cylndrical segments 18*a*–18*b*. A coolant drain plug 50 locates in the removable end cap 40 to facilitate chill roll 10 drainage.

Figure 2:
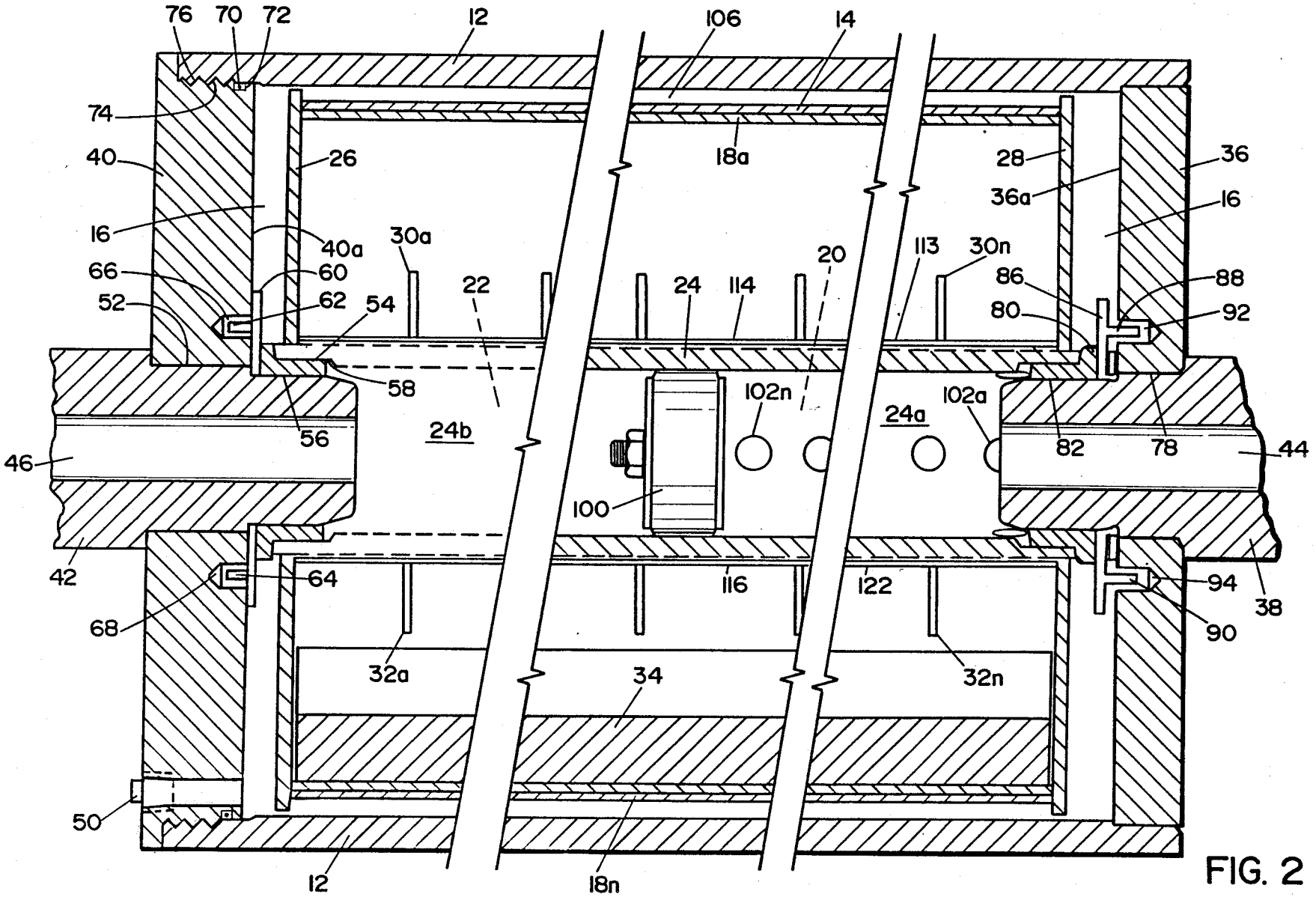
FIG. 2 illustrates a partial cross-sectional view through the vertical axis of the chill roll.
Figure 3:
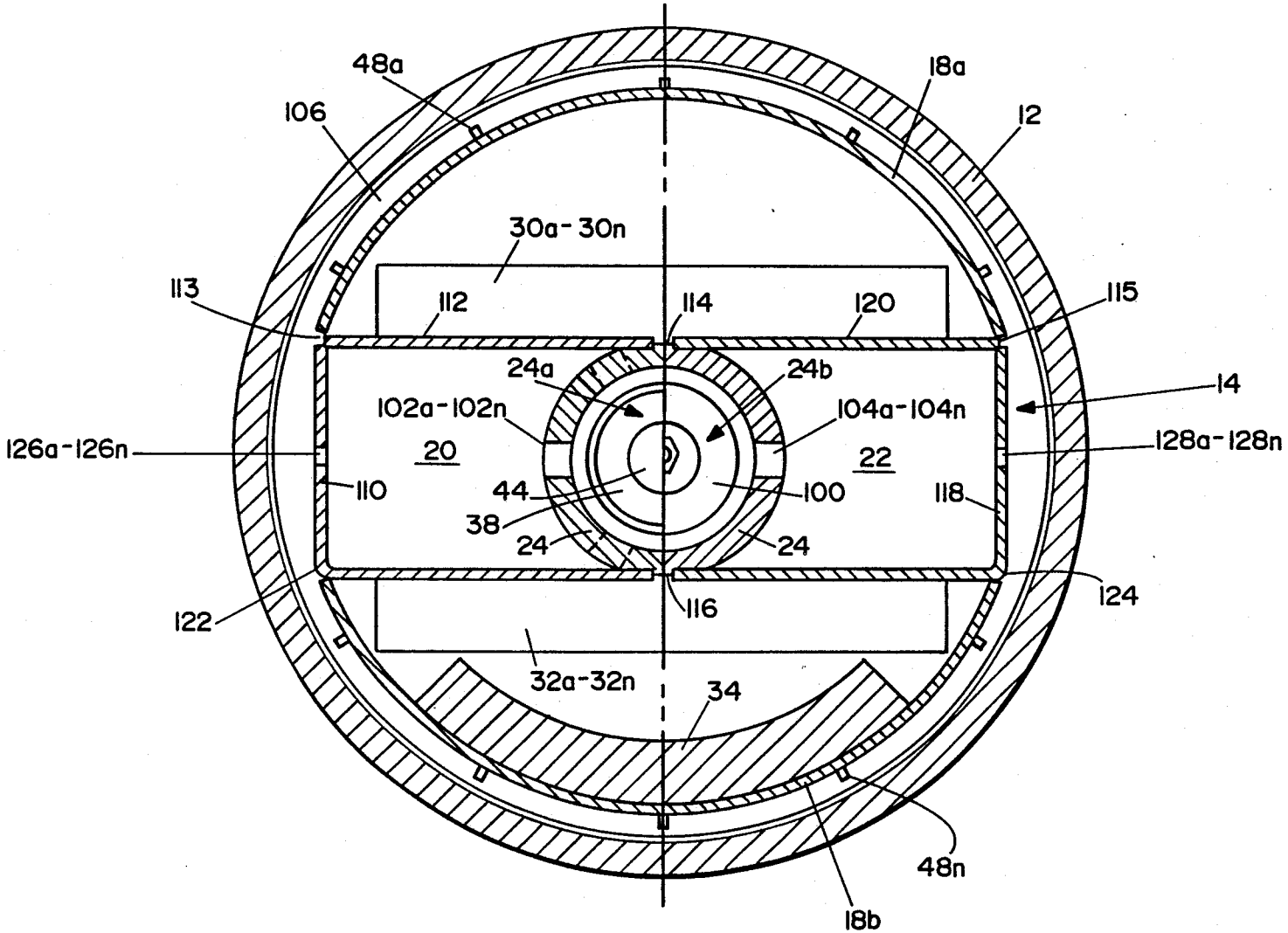
FIG. 3 illustrates a multi-cross-sectional end view of the chill roll including half cross-sectional views through the mid-portions of the coolant supply chamber and coolant return chamber.
Figure 4:
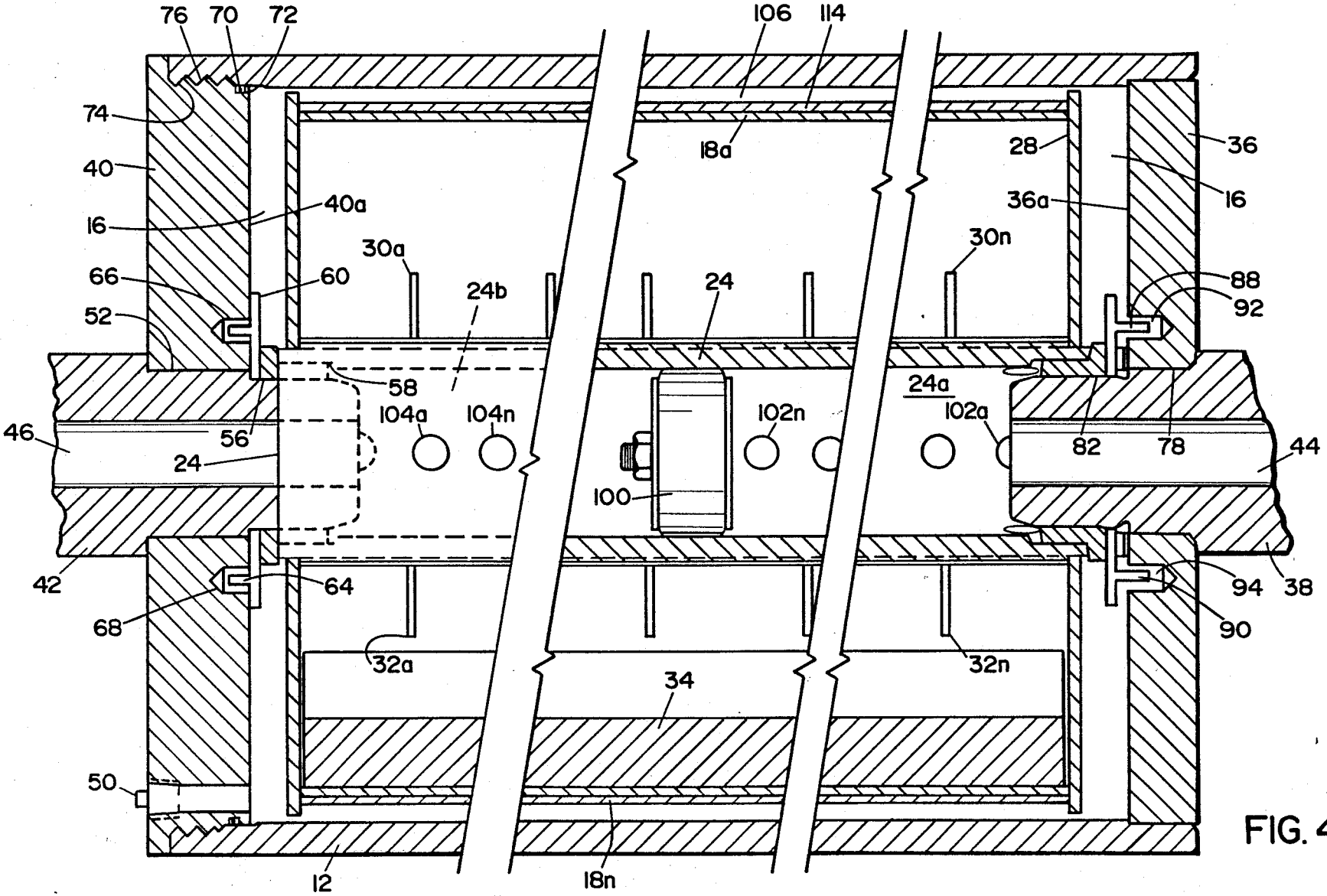
FIG. 4 illustrates a cross-sectional view through the vertical axes of the chill roll illustrating the center tube in plan view engaged over and about the operator end journal.

FIG. 2 illustrates a partial cross sectional view of the support of the inner roll assembly 14 by drive end journal 38 and operator end journal 42 taken through the vertical axis of the chill roll 10 of FIG. 1, where all numerals correspond to those elements previously described. Operator end journal 42 secures in a hole 52 and extends beyond the inner wall of the removable end cap 40. A shouldered water cooled carbon bearing 54 interposes between the annular surface 56 and the inner annular surface 58 of the center tube 24. A thrust washer 60 includes anti-rotational pins 62 and 64 engaged within holes 66 and 68 in the removable end cap 40, and intercedes between the water cooled carbon bearing 54 and the inner surface 40*a* of the removable end cap 40. Removable end cap 40 includes an annular groove 70 and an O-ring seal 72 providing a water tight seal between the removable end cap 40 and the outer roll 12. Threads 74, in the removable end cap 40, engage threads 76 on the interior of the outer roll 12. The drive end journal 38 frictionally engages within hole 78 and extends beyond the inner wall of the end cap 36. A shouldered water cooled carbon bearing 80 interposes between the annular surface 82 of the drive end journal 38 and the inner annular surface 84 of the center tube 24. A thrust washer 86 includes anti-rotational pins 88 and 90 engaged within holes 92 and 94 in the removable end cap 36. A wave washer 96 and the thrust washer 86 both interpose between the water cooled carbon bearing 80 and the inner surface 36*a* of the end cap 36. The center tube 24, being mounted over and being supported by drive end journal 38, operator end journal 42 and water cooled carbon bearings 80 and 54, along with its associated components including weight 34, remains stationary as the outer roll 12 is driven in rotary motion about the inner roll assembly 14 by rotational motion of the drive end journal 38. An expansion plug 100 installs in the mid-portion of the center tube 24, and divides the center tube into a coolant supply chamber 24a and a coolant return chamber 24b. The coolant supply chamber 24a includes a plurality of holes 102a–102n which port to the coolant supply header 20, which in this illustration aligns directly behind the holes 102a–102n. This mechanical (L relationship is illustrated in FIG. 3. Coolant return chamber 24b also includes a plurality of holes 104a–104n oriented 180° from holes 102a–102n, the location of which are illustrated in FIGS. 3 and 4. Holes 104a–104n port the coolant return header 22. The plurality of holes 102a–102n and 104a–104n substantially align in a straight path along vertical tangents of the center tube 24, and also include additional holes included in the holes 102a–102n and 104a–104n radially displaced from the vertical tangential orientation. An annular coolant passage is formed between the outer roll 12 and the inner roll assembly 14.

FIG. 3 illustrates a multi-view cross-sectional end view of the chill roll 10 including a cross section through the mid-portions of the coolant supply and return chambers 24a and 24b, and including he inner roll assembly 14 aligned in the outer roll 12 as viewed from the removable end cap 40. All numerals correspond to those elements previously described. The coolant supply header 20 includes a right angle member 110 and a planar member 112, both of which secure together at a joint 113 and to ridge areas 114 and 116 on the center tube 24. The coolant return header 22 also includes a right angle member 118 and a planar member 120, both of which secure together at a joint 115 and to ridge areas 114 and 116 on the center tube 24. The upper cylindrical segment 18a secures in an appropriate manner to the coolant supply header and return header 20 and 22 at joints 113 and 115. Additionally, joints 122 and 124 join the lower cylindrical segment 18b to the right angle members 110 and 118 of the coolant supply and return headers 20 and 22. A plurality of holes 126a–126n locate along the length of the right angle member 110 of the coolant supply header 20. Another plurality of holes 128a –128n locate along the length of the right angle member 118 of the coolant return header 22.

FIG. 4 illustrates a cross-sectional view through the vertical axis of the chill roll 10 illustrating the center tube 24 in plan view in the left portion of the illustration, and engaged over and about the operator end journal 42. All numerals correspond to those elements previously described. A portion of the plurality of holes 104a–104n located on one side of the center tube 24 are illustrated. The coolant supply chamber 24a lies directly behind the plurality of holes 104a–104n in the center tube 24. Fluid travels to the coolant return chamber 24b through the plurality of holes 104a–104n from the coolant return header 22, illustrated in FIG. 5, which abuts perpendicularly and outwardly from the center tube 24 towards the viewer of the illustration.

Figure 5:
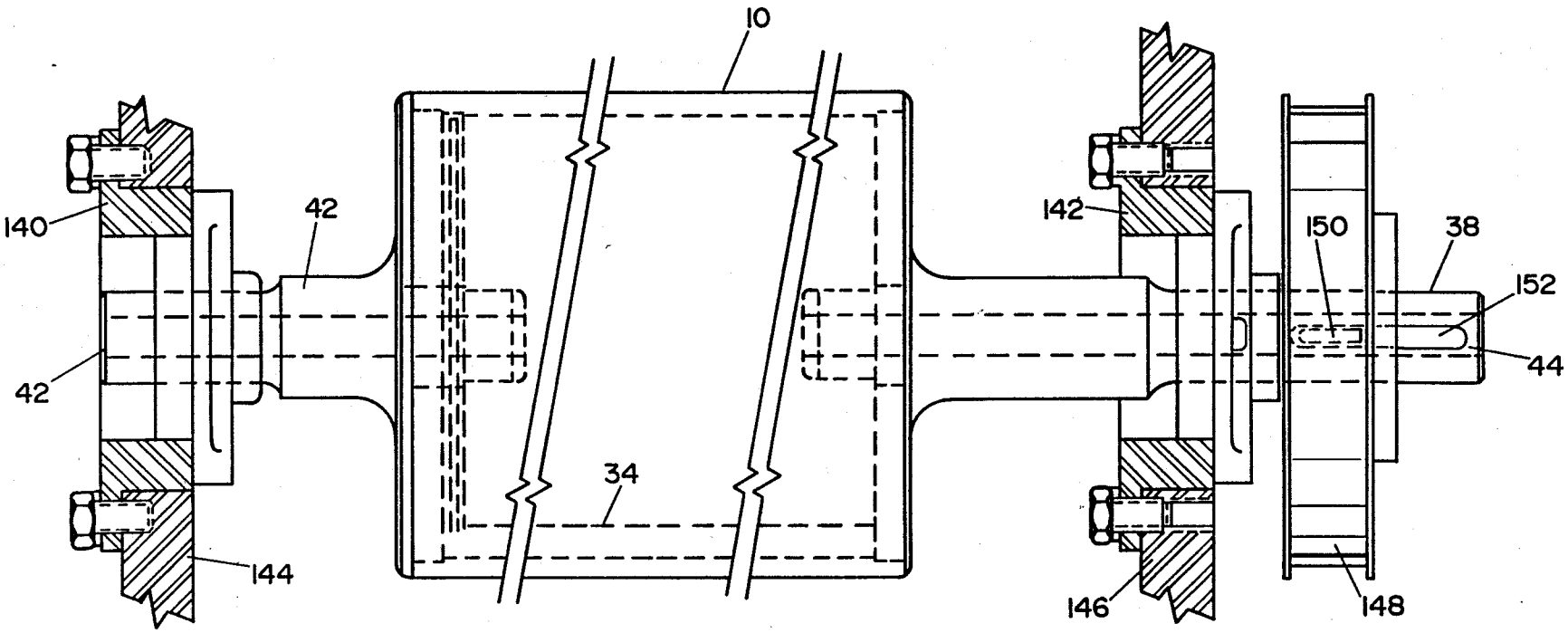
FIG. 5 illustrates the chill roll supported between bearing assemblies.

FIG. 5 illustrates the chill roll 10 supported for rotation between bearings 140 and 142 which are secured to side frames 144 and 146. A pulley 148 secures over the drive end journal 38 with a key 150 which engages in a keyway in the pulley 148 and a slot 152. The pulley 148 is rotated by an external motor imparting rotary motion to the outer roll 12 of the chill roll 10 while the weighted inner roll assembly 14 remains stationary. As the outer roll 12 rotates about the inner roll assembly 14, coolant is introduced and returned from the interior of the chill roll 10 through water tight rotary joints placed over and about the external portion of coolant supply and outlet orifices 44 and 46. Coolant flow is now described in detail in FIGS. 6 and 7.

MODE OF OPERATION

Figure 6:
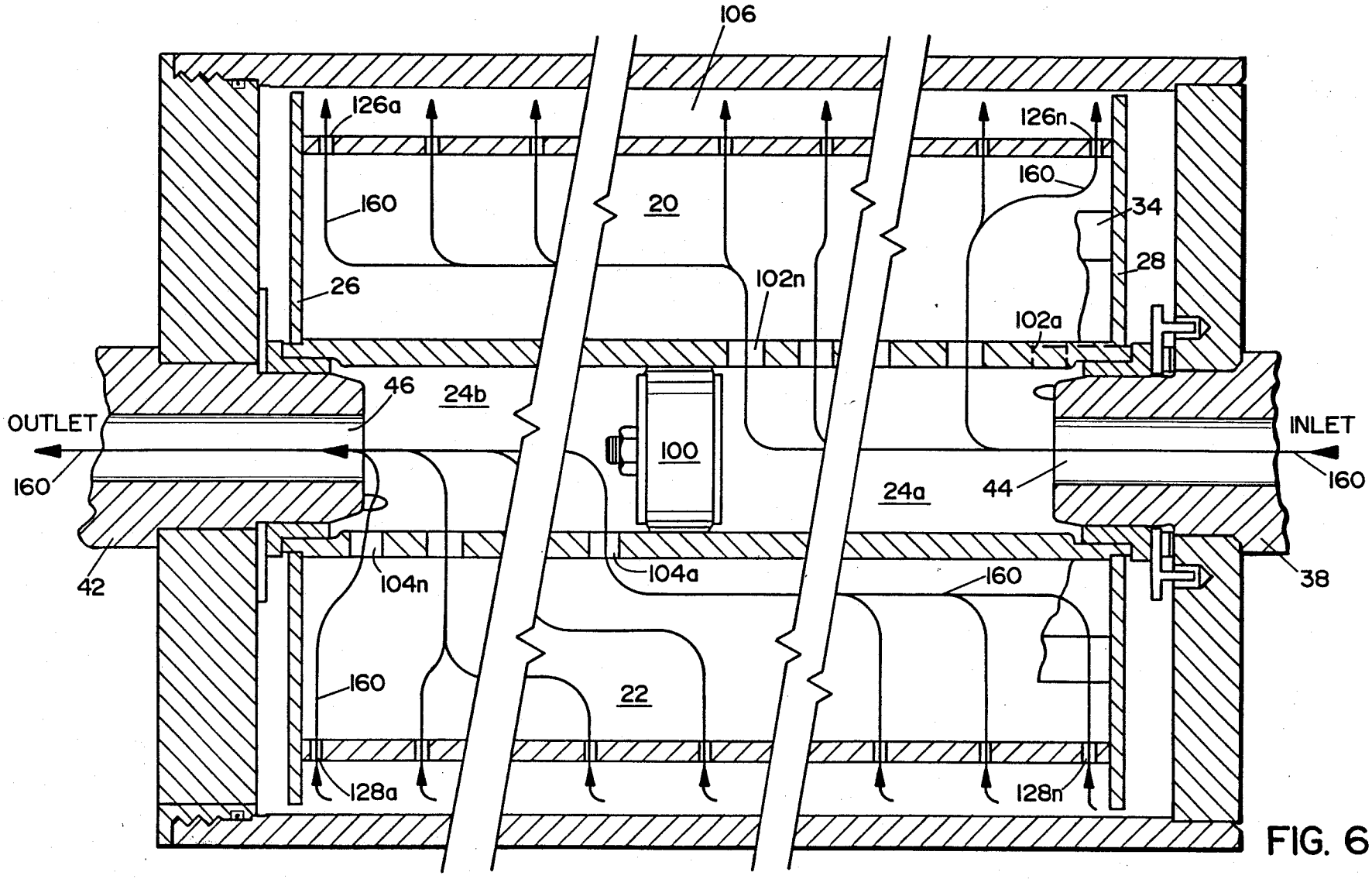
FIG. 6 illustrates a cross-sectional top view of the chill roll through the horizontal plane and an axis of the chill roll.
Figure 7:
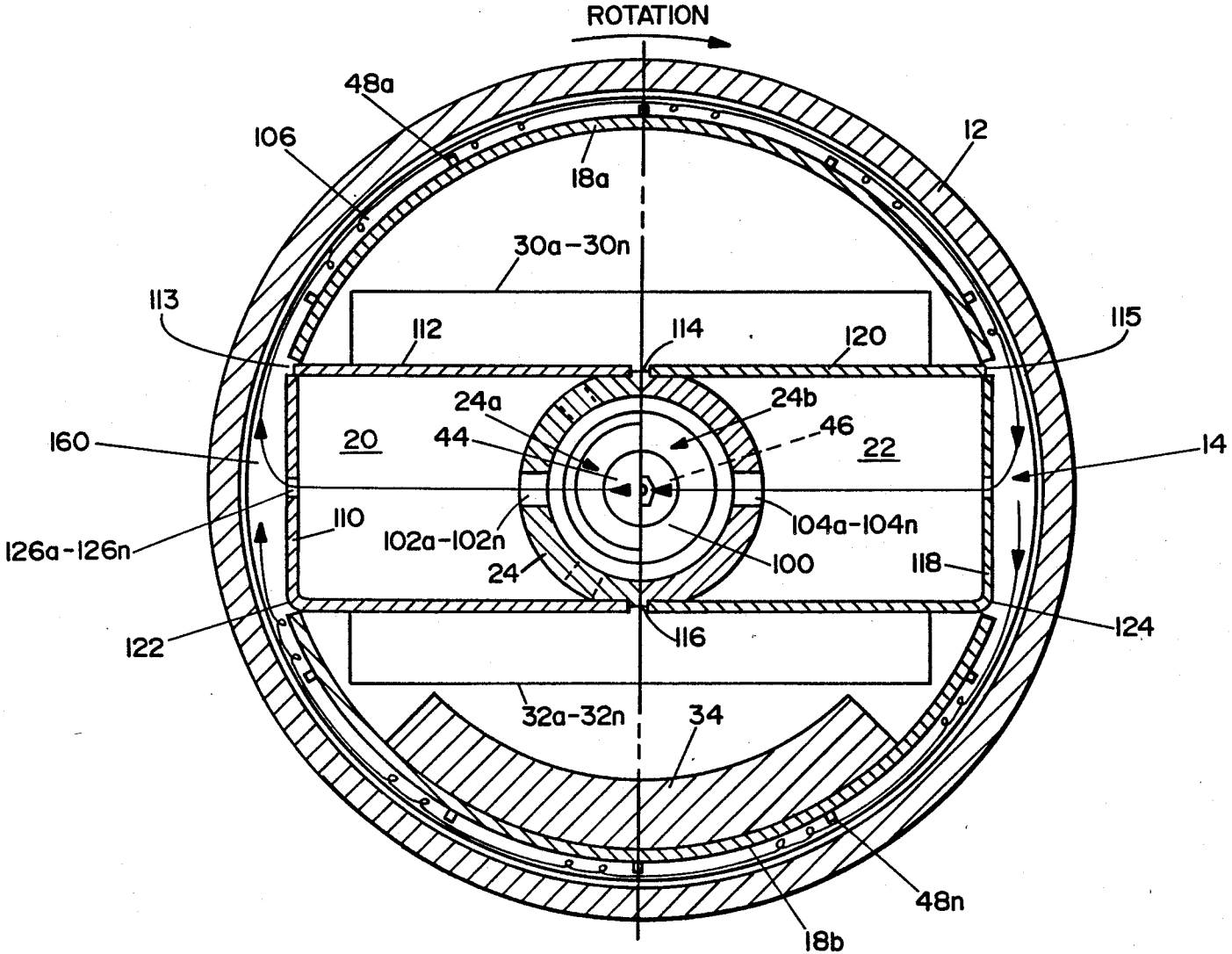
FIG. 7 illustrates the cross section of FIG. 3 and the flow of coolant therein; and, FIG. 8 illustrates an alternative embodiment in cross section through the vertical axis of the chill roll.

FIGS. 6 and 7 best illustrate the mode of operation of the chill roll 10 where all numerals correspond to those elements previously described.

FIG. 6 illustrates a cross-sectional top view through the horizontal plane and axis of the chill roll 10 illustrating longitudinal and lateral flow of coolant through the chill roll 10.

FIG. 7 illustrates a cross-sectional view of FIG. 3 illustrating circular flow of coolant 160 between the annular coolant passage 106, between the outer roll 12 and the inner roll assembly 14. It is noted that the outer roll 12 is in constant rotary motion on a common axis about the stationary inner roll assembly 14 as coolant flows through the chill roll 10. Coolant 160 is supplied to the coolant supply chamber 24a through the coolant supply orifice 44. Coolant proceeds and flows horizontally and longitudinally along the length of the coolant supply chamber 24a, and then flows horizontally and laterally through the plurality of holes 102a–102n, horizontally and laterally into the coolant supply header 20 where the uniform temperature coolant, not yet exposed to out-roll heat gradient, is uniformly directed and distributed horizontally and laterally through the plurality of holes 126a–126n and into the annular coolant passage 106.

With reference to FIG. 7, movement of uniform temperature coolant 160 from holes 126a–126n located along the length of the coolant supply header 20, and rotary motion of the outer roll 12 by means of inertial feed causes coolant 160 to circumferentially traverse along the cylindrical segment 18a of the inner roll assembly 14, and within the annular coolant passage 106 to the plurality of holes 128a –128n in the coolant return header 22. The coolant 160, With a substantially increased temperature, is collected by the coolant return header 22 through holes 128a–128n. The warmed coolant 160 is collected and passes through holes 104a–104n into the coolant return chamber 24b and overboard through the coolant outlet orifice 46. Coolant 160 is distributed uniformly along the entire length of the inner roll assembly 14 by the holes 126a–126n in the coolant supply header 20, and causes heat transfer from the outer roll 12 to the coolant 160 to be uniform across the annular coolant passage 106. A portion of the coolant proceeds full circle beyond the coolant return header 22, past and by the cylindrical segment 18b of the inner roll assembly 14, and also continues to remove heat from the outer roll 12 in a uniform fashion. The temperature across the rotating outer roll is uniformly lowered by uniform heat transfer accomplished by uniform heat removal by the coolant 160 in the annular coolant passage 106. Coolant flow turbulence is generated between the rotating outer roll 12 and the inner roll assembly 14 Increased heat transfer occurs as the coolant 160 passes over the turbulence inducer bars 48a–48n located longitudinally along the cylindrical segments 18a and 18b. In the alternative the turbulence inducer bars 48a–48n can be located on the inner surface of the outer roll 12 to accomplish the same turbulence generation. The turbulence inducer bars 48a–48n can also be suspended in the coolant flow between the outer and inner roll assemblies.

DESCRIPTION OF THE ALTERNATIVE EMBODIMENT

Figure 8:
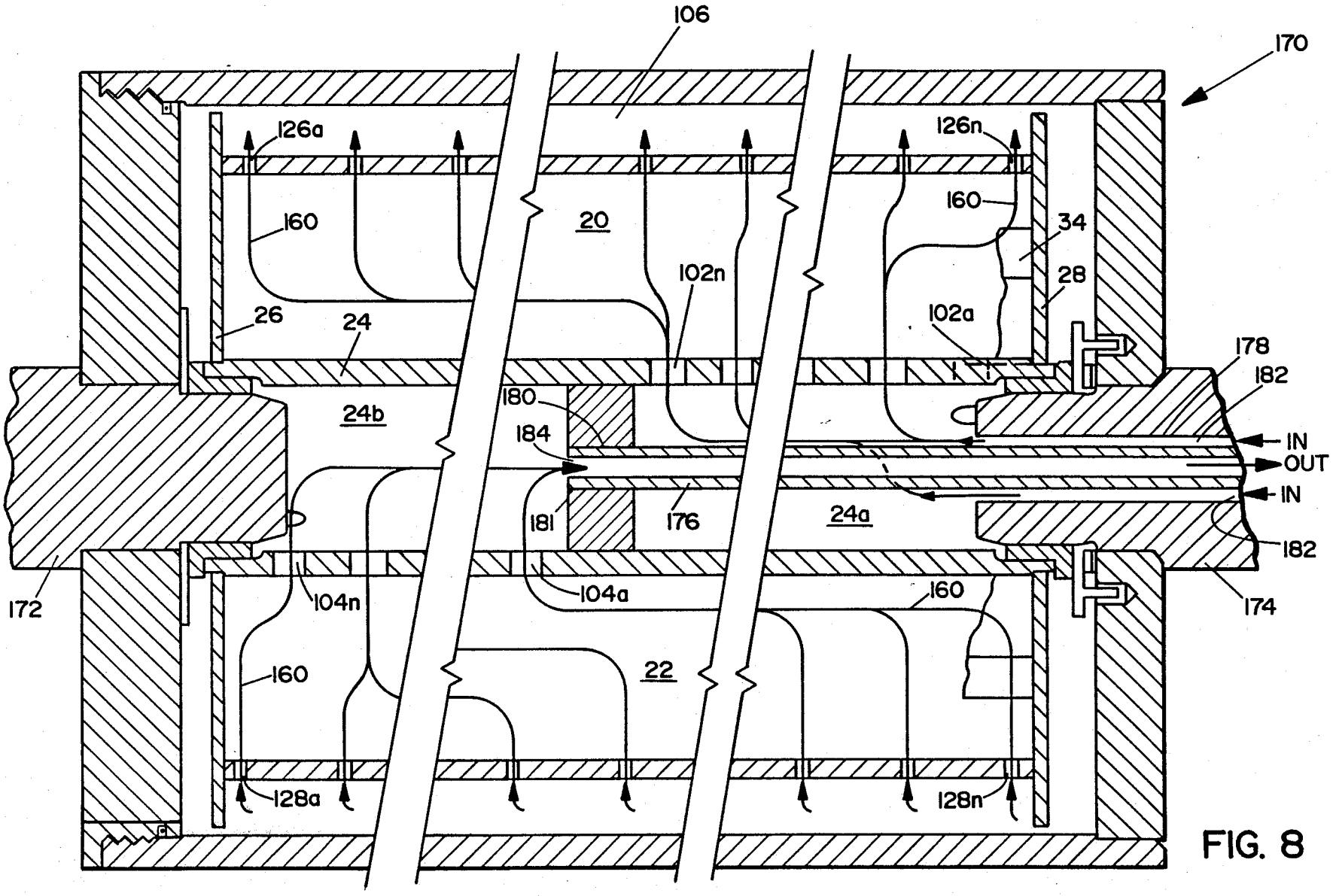

FIG. 8 illustrates an alternative embodiment of a chill roll 170, where all numerals correspond to those elements previously described, featuring a solid operator end journal 172 and a drive end journal 174 with concentric supply and return passage tubes or orifices. A coolant return tube 176 is concentrically aligned in hole 178 of the drive end journal 174 and terminates in hole 180 of a plug 181, and connects to the coolant return chamber **24*b*. Plug 181 divides the center tube 24 into a coolant supply chamber 24*a* and a coolant return chamber 24*b*. An annular coolant supply chamber 182 locates concentrically in the drive end journal 174 between the sides of the hole 178 and about the outer circumference of the return tube 176**.

In operation, coolant 160 enters the annular coolant supply chamber 182, proceeds into the coolant supply chamber **24*a*, and flows through holes 102*a*–102*n*, through coolant supply header 20, through holes 126*a*–126*n*, through annular coolant passage 106 circumferentially about the inner roll assembly 14 as previously described, through holes 104*a*–104*n* and into the coolant return chamber 24*b*. Coolant 160 proceeds from the coolant return chamber 24*b* through an orifice 184 in and through the return tube 176. An external rotary joint connects over the drive end journal 174 for passage of the coolant 160 in their respective directions through the annular coolant supply chamber 182 and return tube 176**.

Various modifications can be made to the present invention without departing from the apparent scope thereof. The chill roll can be used as a paper or web dryer. The chill roll can also be utilized in other applications in addition to the printing industry. The turbulence bars can be arranged in any geometrical configuration to enhance heat transfer.

We claim:

1. Chill roll comprising:
   a. cylindrical outer rotating chill roll;
   b. cylindrical outer rotating opposing end roll journals supporting said chill roll and with a coolant inlet and a coolant outlet in said journals;
   c. cylindrical inner stationary roll including opposing upper and lower cylindrical segments secured to a coolant supply header and a coolant return header, said headers secured about a center tube, supported on said end journals, and of a diameter less than that of said outer chill roll with an annular space therebetween;
   d. plurality of holes in a coolant supply chamber in a first portion of said center tube and a like plurality of holes in a coolant return chamber in a second portion of said center tube; and,
   e. plurality of holes in said coolant supply header and in said coolant return header whereby coolant flows through said end journal, sad coolant supply chamber, said coolant supply header, in said space between said rolls, said coolant return header, said coolant return chamber, and out said end journal, and said stationary inner roll distributes and collects coolant across the rotating outer roll thereby evenly enhancing heat transfer.

2. Chill roll of claim 1 including means for creating a high turbulence in said annular space between said rotating roll and said stationary roll, whereby said turbulence means provides for enhanced heat transfer.

3. Chill roll of claim 1 wherein said turbulence means comprises turbulence inducer bars positioned on an outer surface of said inner roll.

4. Chill roll of claim 1 wherein said turbulence means comprises turbulence inducer bars positioned on an inner surface of said outer roll.

5. Chill roll comprising:
   a. cylindrical outer rotating chill roll;
   b. cylindrical outer rotating opposing end roll journals supporting said chill roll and with a coolant inlet and a coolant outlet in said journals;
   c. cylindrical inner stationary roll including opposing upper and lower cylindrical segments secured to a coolant supply header and a coolant return header, said headers secured about a center tube, supported on said end journals, and of a diameter less than that of said outer chill roll with an annular space therebetween;
   d. plurality of holes in a coolant supply chamber in a first portion of said center tube and a like plurality of holes in a coolant return chamber in a second portion of said center tube;
   e. plurality of holes in said coolant supply header and in sad coolant return header whereby coolant flows through said end journal, sad coolant supply chamber, said coolant supply header, in said space between said rolls, said coolant return header, said coolant return chamber, and out said end journal, and said stationary inner roll distributes and collects coolant across the rotating outer roll thereby evenly enhancing heat transfer; and,
   f. means on said cylindrical inner stationary roll for creating turbulence in an annular space between said rotating roll and said stationary roll for enhancing heat transfer.

6. Chill roll comprising:
   a. a cylindrical outer rotating chill roll;
   b. opposing drive end journal and an end journal supporting said roll and with a coaxial inlet and outlet in said drive journal;
   c. cylindrical inner stationary roll including opposing upper and lower cylindrical segments secured to a coolant supply header and a coolant return header and said headers secured about a center tube, supported on said end journal and of a diameter less than that of said outer ch11 roll with an annular space therebetween;
   d. coolant return tube concentrically aligned in a hole of said drive end journal and terminating at a hole in a plug at a mid-portion of said center tube;
   e. a coolant supply chamber between said coolant return tube and said center tube, said coolant supply header positioned about an outer circumference of said center tube;
   f. a coolant return chamber in said center tube and between said plug and said end journal, and said coolant return header positioned about an outer circumference of said center tube;
   g. plurality of lower and upper holes in said coolant supply header; and,
   h. plurality of upper and lower holes in said coolant return header whereby coolant flows through said drive end journal, said coolant supply chamber, said coolant supply header, in said space, between said rolls, said coolant return header, said coolant return chamber, and out said end journal, and said stationary inner roll distributes and collects coolant across the rotating outer roll thereby evenly enhancing heat transfer 7. Chill roll of claim 6 including means for creating a high turbulence in an annular space between said rotating roll and said stationary roll, whereby said turbulence means provides for enhanced heat transfer.

8. Chill roll of claim 6 wherein said turbulence means comprises turbulence inducer bars positioned on an outer surface of said inner roll.

9. Chill roll of claim 6 wherein said turbulence means comprises turbulence inducer bars positioned on an inner surface of said outer roll.

10. Chill roll of claim 6 including a weight in said lower cylindrical segment.

11. Chill roll comprising:

a. a cylindrical outer rotating chill roll;

b. opposing drive end journal and an end journal supporting said roll and with a coaxial inlet outlet in said drive journal; and c. cylindrical inner stationary roll including opposing upper and lower cylindrical segments secured to a coolant supply header and a coolant return header and said headers secured about a center tube, supported on said end journal and of a diameter less than that of said outer chill roll with an annular space therebetween;

d. coolant return tube concentrically aligned in a hole of said drive end journal and terminating at a hole in a plug at a mid-portion of said center tube;

e. a coolant supply chamber between said coolant return tube and said center tube, sad coolant supply header positioned about an outer circumference of said center tube;

f. a coolant return chamber in said center tube and between said plug and said end journal, and said coolant return header positioned about an outer circumference of said center tube;

g. plurality of lower and upper holes in said coolant supply header;

h. plurality of upper and lower holes in said coolant return header whereby coolant flows through said drive end journal, said coolant supply chamber, said coolant supply header, in said space, between said rolls, said coolant return header, said coolant return chamber, and out said end journal, and said stationary inner roll distributes and collects coolant across the rotating outer roll thereby evenly enhancing heat transfer; and, j. means on said cylindrical inner stationary roll for creating turbulence in an annular space between said rotating roll and said stationary roll for enhancing heat transfer.

* * * * *